US008496325B2

(12) United States Patent
Mitsuzawa

(10) Patent No.: US 8,496,325 B2
(45) Date of Patent: Jul. 30, 2013

(54) LIQUID DISCHARGING METHOD AND LIQUID DISCHARGING APPARATUS

(75) Inventor: Toyohiko Mitsuzawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 286 days.

(21) Appl. No.: 12/703,707

(22) Filed: Feb. 10, 2010

(65) Prior Publication Data

US 2010/0201771 A1 Aug. 12, 2010

(30) Foreign Application Priority Data

Feb. 12, 2009 (JP) ..... 2009-030320

(51) Int. Cl.
*B41J 2/01* (2006.01)
*B41J 29/38* (2006.01)

(52) U.S. Cl.
USPC ..... 347/102; 347/16

(58) Field of Classification Search
USPC ..... 347/102
See application file for complete search history.

(56) References Cited

U.S. PATENT DOCUMENTS 6,786,589 B2 * 9/2004 Suzuki et al. ..... 347/102
7,244,021 B2 * 7/2007 Arai ..... 347/102
7,275,804 B2 * 10/2007 Matsushima ..... 347/40
7,473,718 B2 * 1/2009 Ishikawa ..... 522/31
7,510,277 B2 * 3/2009 Konno et al. ..... 347/102
7,575,315 B2 * 8/2009 Williams et al. ..... 347/102
2007/0024686 A1 2/2007 Kadomatsu et al.
2007/0279470 A1 * 12/2007 Arai ..... 347/102
2008/0055379 A1 * 3/2008 Ishikawa et al. ..... 347/102
2008/0158278 A1 * 7/2008 Inoue ..... 347/12
2008/0218574 A1 * 9/2008 Furuno et al. ..... 347/100

FOREIGN PATENT DOCUMENTS

JP 2000-158793 A 6/2000
JP 2007-230182 A 9/2007

* cited by examiner

*Primary Examiner* — Stephen Meier
*Assistant Examiner* — Leonard S Liang
(74) *Attorney, Agent, or Firm* — Kilpatrick Townsend & Stockton LLP

(57) ABSTRACT

A liquid ejecting method using a liquid discharging apparatus, the method including: a first process, forming dots on a medium in a predetermined direction at a first interval by discharging liquid that is cured when electromagnetic waves are irradiated to the medium; a second process, irradiating the dots formed on the medium with electromagnetic waves; a third process, forming dots in the predetermined direction at the first interval so that the dots formed in the first process and the dots formed in the third process are positioned in the predetermined direction at a second interval which is shorter than the first interval; and a fourth process, irradiating the dots formed on the medium with electromagnetic waves.

7 Claims, 13 Drawing Sheets

LIQUID DISCHARGING METHOD AND LIQUID DISCHARGING APPARATUS

BACKGROUND

1. Technical Field

The present invention relates to liquid discharging method and liquid discharging apparatus.

2. Related Art

A printer that performs printing using a liquid (e.g., UV ink) that is cured by the irradiation of electromagnetic waves (e.g., ultraviolet (UV)) is known. In the printer, after liquid is discharged from nozzles to a medium (e.g., paper, film, etc.), the medium is irradiated with electromagnetic waves. By doing so, since dots are cured and fixed to the medium, it is possible to perform good printing even on a medium that poorly absorbs liquid (e.g., see JP-A-2000-158793).

When the dots are formed at a high density on a medium, if adjacent dots contact each other before the irradiation of electromagnetic waves, there is the possibility of the dots spreading.

SUMMARY

An advantage of some aspects of the invention is that suppress the dots from spreading even in cases where the dots are formed at a high density.

An aspect of the invention relates to a liquid ejecting method using a liquid discharging apparatus, the method including: a first process, forming dots on a medium in a predetermined direction at a first interval by discharging liquid that is cured when electromagnetic waves are irradiated to the medium; a second process, irradiating the dots formed on the medium with electromagnetic waves; a third process, forming dots in the predetermined direction at the first interval so that the dots formed in the first process and the dots formed in the third process are positioned in the predetermined direction at a second interval which is shorter than the first interval; and a fourth process, irradiating the dots formed on the medium with electromagnetic waves.

Further aspects of the invention are obvious by the description of the specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
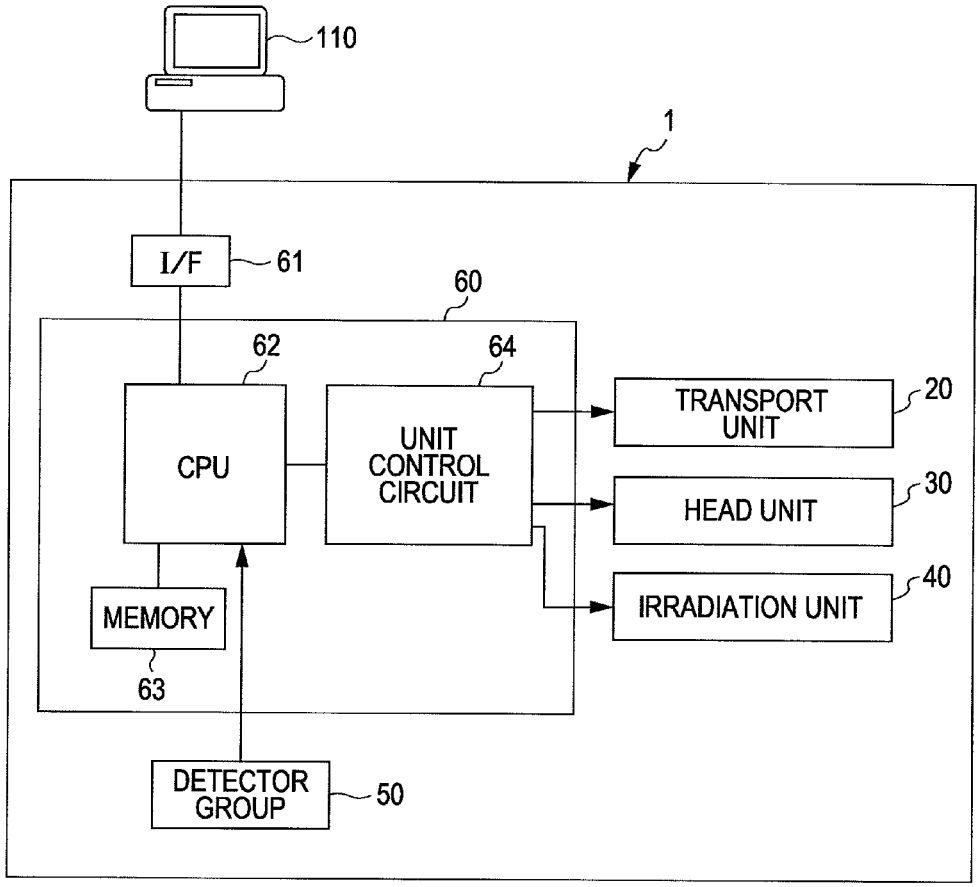
FIG. 1 is a block diagram of the overall configuration of the printer.

The below particulars are at least obvious by means of the descriptions of the specification and the accompanying drawings.

A liquid discharging method using a liquid discharging apparatus, the method includes a first process, forming dots on a medium in a predetermined direction at a first interval by discharging liquid that is cured when electromagnetic waves are irradiated to the medium; a second process, irradiating the dots formed on the medium with electromagnetic waves; a third process, by forming dots in the predetermined direction at the first interval so that the dots formed in the first process and the dots formed in the third process are positioned in the predetermined direction at a second interval which is shorter than the first interval; and a fourth process, irradiating the dots formed on the medium with electromagnetic waves.

According to the liquid discharging method, the spreading can be suppressed in cases where the dots are formed at high density.

In the liquid discharging method, the medium is transported in a transport direction, the first process is performed using a first nozzle row which has a plurality of nozzles that are arranged at the first interval in the predetermined direction; and the third process is performed using a second nozzle row which has a plurality of nozzles that are arranged at the first interval in the predetermined direction, the second nozzle row being positioned downstream of the transport direction as compared with the first nozzle row.

According to the liquid discharging method, by discharging the liquid from the first and second nozzle row while the medium is transported in the transport direction, the spreading can be suppressed in cases where the dots are formed at high density.

In the liquid discharging method, it is preferable that, in the first process, after the dots are formed in a first area of the medium, the dots are formed in a second area that is different from the first area, and in the third process, after the dots are formed in the second area of the medium, the dots are formed in the first area.

According to the liquid discharging method, the image quality of the first and second areas can be made more uniform.

In the liquid discharging method, it is preferable that, in the first process, after the dots of a first color are formed in the first area of the medium, and after the dots of the first color are formed in a second area which is different from the first area, the dots of a second color which is different from the first color are formed in the first area and the second areas.

According to the liquid discharging method, the size of the dots of each color can be made uniform and image quality can be improved.

In the liquid discharging method, it is possible that the first process is performed by discharging the liquid from the nozzles while the nozzle row having a plurality of nozzles that are arranged in the predetermined direction are moved to a movement direction; and after the first and second processes, the third process is performed by discharging the liquid from the nozzles while the nozzle row are moved to the movement direction.

According to the liquid discharging method, by performing the operation of the dot formation and the transport of the medium repeatedly, the spreading can be suppressed in cases where the dots are formed at high density.

In the liquid discharging method, it is preferable that the dots formed in the first and third processes are formed by discharging a colored liquid; and the method further includes: after the fourth process, by discharging an uncolored liquid that is cured when electromagnetic waves are irradiated to the medium, forming dots on the medium in the predetermined direction at an interval which is shorter than the first interval; and irradiating the dots formed on the medium with electromagnetic waves.

According to the liquid discharging method, the gloss of the image can be improved.

In the liquid discharging method, it is preferable that the irradiation volume of the electromagnetic waves in the fourth process is larger than that in the second process.

According to the liquid discharging method, the extension of the dots can be controlled, while suppressing the spreading of the ink.

In the liquid discharging method, it is preferable that after the fourth process, further performing irradiation of electromagnetic waves to perform a preliminary curing in the dots formed on the medium and thereafter further performing irradiation of electromagnetic waves to perform main curing in the dots formed on the medium.

According to the liquid discharging method, the image quality can be adjusted by the preliminary curing and the main curing.

In the liquid discharging method, it is preferable that the method further includes: a fifth process after the fourth process, forming dots on the medium in the predetermined direction at an interval which is shorter than the first interval by discharging an uncolored liquid that is cured when electromagnetic waves are irradiated to the medium; a sixth process irradiating the dots formed on the medium with electromagnetic waves; a seventh process irradiating the dots formed on the medium with electromagnetic waves; and the dots formed in the first and third processes are formed by discharging a colored liquid; the second, fourth and sixth process are for performing a preliminary curing in the dots formed on the medium; and the seventh process is for performing main curing in the dots formed on the medium.

According to the liquid discharging method, the gloss of the image can be improved and the image quality can be adjusted by the preliminary curing and the main curing.

In the liquid discharging method, it is preferable that the six process is not performed if the fifth process is not performed.

First Embodiment

In the first embodiment, a line printer (printer 1) as the liquid discharging apparatus is described by way of example.

Configuration of the Printer

Figure 2A:
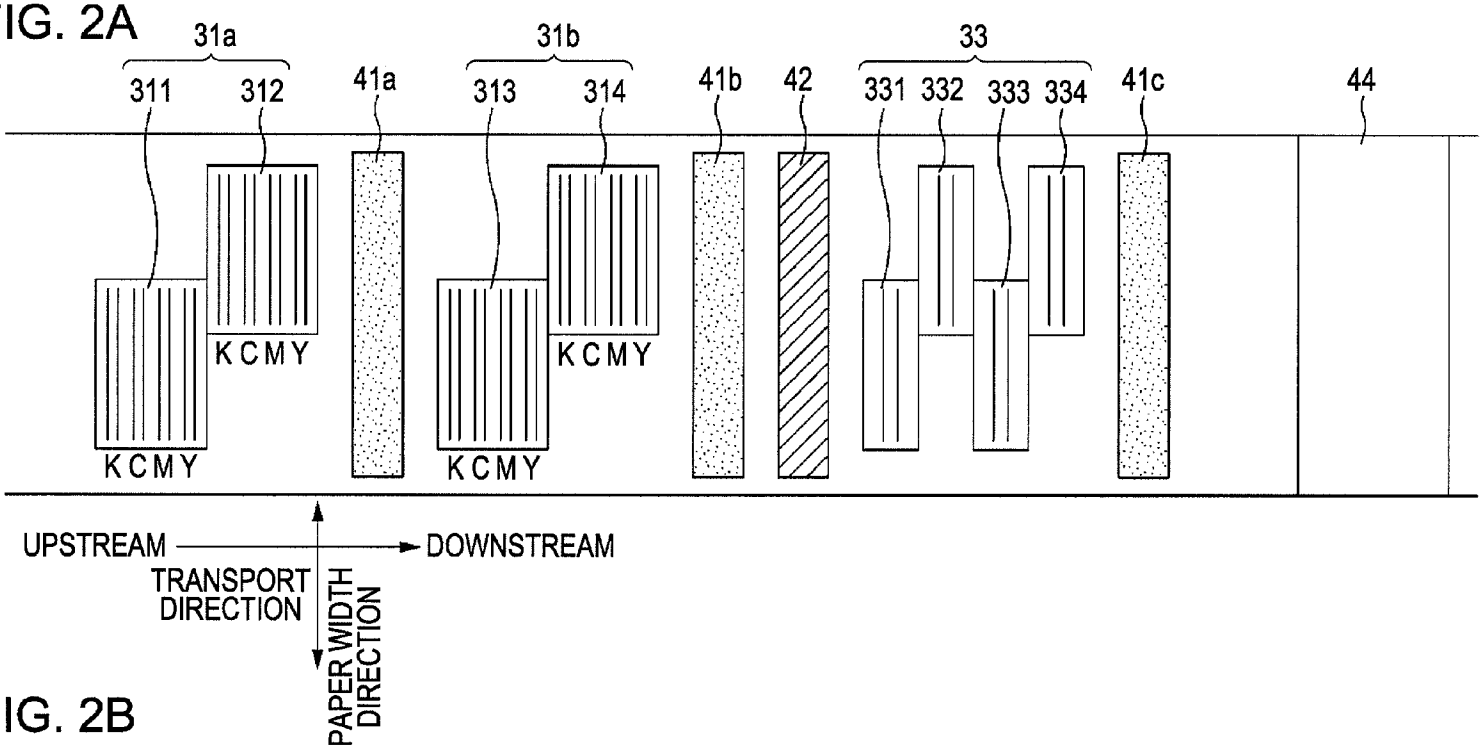
FIG. 2A is a schematic configuration view of a circumference of the printing area.
Figure 2B:
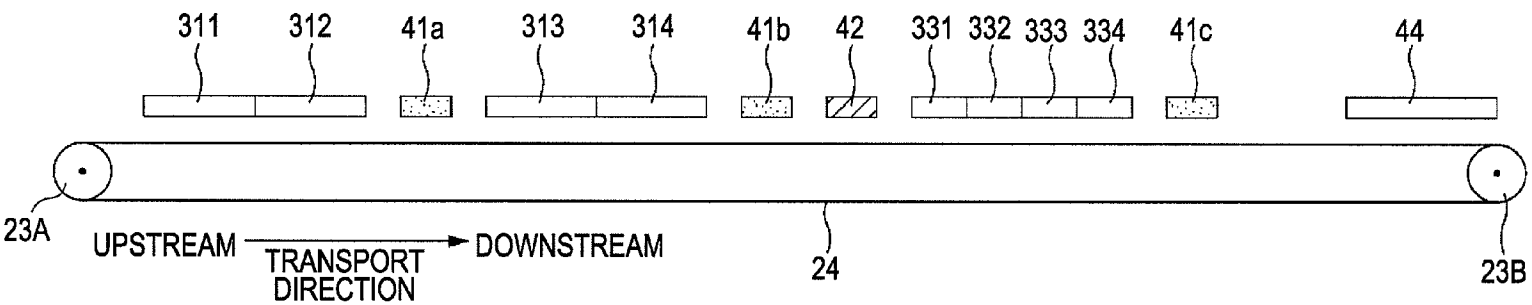
FIG. 2B is a diagram as seen from the side of FIG. 2A.

FIG. 1 is a block diagram of the overall configuration of the printer 1. Moreover, FIG. 2A is a schematic configuration view of the circumference of the printing area, and FIG. 2B is a diagram as seen from the side of FIG. 2A.

A printer 1 is a printing device that prints an image on the medium such as a paper, a texture, and a film, and it receives the printing data from a computer 110 which is an external device to print image on the medium according to the printing medium.

The printer 1 of the embodiment is the device that prints the images on the medium by discharging, as one example of liquid, an ultraviolet curable ink (hereinafter, UV ink) that is cured by the irradiation of ultraviolet (hereinafter, UV). UV ink is an ink which includes an ultraviolet curing resin, and when UV is irradiated, a photopolymerisation reaction takes place on the ultraviolet curing resin, resulting in curing. Furthermore, the printer 1 of the embodiment prints the images using four color CMYK UV ink (color ink) and an uncolored and transparent UV ink (clear ink).

The printer 1 of the embodiment includes a transport unit 20, a head unit 30, an irradiation unit 40, a detector group 50, and a controller 60. When the controller 60 receives the printing data from the computer 110 which is the external device, it controls each of the units (transport unit 20, a head unit 30, and an irradiation unit 40) to print the images on the medium. The situation in the printer 1 is being monitored by the detector group 50, and the detector group 50 outputs the detecting results to the controller 60. The controller 60 controls each of the units based on the detecting results output from the detector group 50.

The transport unit 20 transports the medium (e.g., paper) in the predetermined direction (hereinafter, transport direction). The transport unit 20 includes an upstream transport roller 23A, a downstream transport roller 23B, and a belt 24. When a transport motor which is not shown rotates, the upstream transport roller 23A and the downstream transport roller 23B rotate, and the belt 24 rotates. The medium (for example, a paper) which is fed by a paper feeding roller (not shown) is transported to the printable area (an area which is opposed to the head) by means of the belt 24. The belt 24 transports the medium, so that the medium is moved relative to the head unit 30 in the transport direction. The medium passes through the printable area and is discharged outside by the belt 24. Furthermore, the medium is electrostatically adsorbed or vacuum adsorbed to the belt 24 during the transportation.

The head unit 30 discharges UV ink to the medium. Furthermore, in the embodiment, as UV ink, the colored ink and the uncolored and transparent clear ink for forming the images are used. The head unit 30 discharges each inks to the medium during transporting, thereby forming the dots on the medium and printing the images on the medium.

The head unit 30 of the embodiment includes, in order from the upstream of the transport direction, an upstream color head group 31*a*, a downstream color head group 31*b*, and a clear ink head group 33.

Furthermore, each of the heads group of the head unit 30 will be described later.

The irradiation unit 40 irradiates UV on the UV ink (dots) landed on the medium. The dots formed on the medium are cured by the irradiation of UV from the irradiation unit 40. The irradiation unit 40 of the embodiment includes a first preliminary curing irradiation unit 41, a second preliminary curing irradiation unit 42, and a main curing irradiation unit 44.

The first preliminary curing irradiation unit 41 cures the surface of the dots to prevent the ink from spreading among the dots. Furthermore, the irradiation volume of the first preliminary curing irradiation unit 41 is low, and the dots continue to extend even after the first preliminary curing. In the embodiment, the first preliminary curing irradiation unit 41 has a first irradiation unit 41*a*, a second irradiation unit 41*b*, and a third irradiation unit 41*c*. In the embodiment, as a light source of UV irradiation of each of the irradiation units, the light emitting diode (LED) is used. It is possible for the LED to readily change the irradiation energy by controlling the magnitude of the input current.

The first irradiation unit 41*a* is positioned between the upstream color head group 31*a* and the downstream color head group 31*b*, and the second irradiation unit 41*b* is positioned downstream in the transport direction of the downstream color head group 31*b*. Furthermore, the third irradiation unit 41*c* is positioned downstream in the transport direction of the clear ink head group 33.

The second preliminary curing irradiation unit 42 further cures the surfaces of the dots to prevent the dots from extending. In the embodiment, the LED is also used in the light source of the UV irradiation of the second preliminary curing irradiation unit 42.

Furthermore, the second preliminary curing irradiation unit 42 is positioned between the second irradiation unit 41*b* of the first preliminary curing irradiation unit 41 and the clear ink head group 33.

The main curing irradiation unit 44 solidifies the dots completely. The main curing irradiation unit 44 of the embodiment includes a lamp (metal halide lamp, mercury lamp, etc.)

Furthermore, the main curing irradiation unit 44 is positioned downstream of the transport direction as compared with the third irradiation unit 41*c* of the first preliminary curing irradiation unit 41.

Furthermore, the details of the preliminary curing and the main curing will be described later.

A rotary type encoder (not shown) and a paper detecting sensor (not shown), etc. are included in the detector group 50. The rotary type encoder detects the amount of the rotation of the upstream transport roller 23A or the downstream transport roller 23B. Based on the detecting results of the rotary type encoder, transport amounts of the medium can be detected. The paper detecting sensor detects the position of the tip of the medium during the paper feeding.

A controller 60 is the control unit for controlling the printer. The controller 60 has an interface unit 61, a CPU 62, a memory 63, and a unit controlling circuit 64. The interface unit 61 transmits and receives the signal between the computer 110 and the printer 1 which is an external device. The CPU 62 is the operation processing device for controlling the entire printer. The memory 63 ensures the areas that store the programs of the CPU 62 or working areas, and it has memory elements such as a RAM, an EEPROM or the like. The CPU 62 controls each of the units bay way of the unit controlling circuit 64, according to the programs stored in the memory 63.

Printing Operation

UV ink is discharged from the upstream color head group 31*a* while the medium is transported in the transport direction, so that the dots are formed on the medium in the paper width direction with an intervals of 1/360 inch, and the dots are irradiated with the UV from the first irradiation unit 41*a* and are subject to first preliminary curing. Furthermore, the UV ink is discharged from the downstream color head group 31*b* while the medium is transported, so that the dots inch are formed an intervals of 1/360 between the dots of paper width direction which are formed by the upstream color head group 31*a*. In short, the dots are formed in the paper width direction at intervals of 1/720 inch. The dots are irradiated with UV from the second irradiation unit 41*b*, and they are subject to first preliminary curing. Furthermore, each of the dots formed on the medium are irradiated with UV from second preliminary curing irradiation unit 42, and they are subject to second preliminarily curing. Thereafter, clear ink is applied on each of the dots by means of the clear ink head group 33, and the applied clear ink is irradiated with UV from the third irradiation unit 41*c*, and it is subject to first preliminarily curing. Furthermore, each dot on the medium are irradiated with UV from the main curing irradiation unit 44, and they are subject to main curing. By doing so, the images are printed on the medium.

Head Unit

Next, the configuration of the head unit 30 which is shown in FIGS. 2A and 2B will be described.

The head unit 30 of the embodiment includes, as described above, the upstream color head group 31*a*, downstream color head group 31*b*, and the clear ink head group 33.

The upstream color head 31*a* discharges the color ink for printing the images. The upstream color head group 31*a* of the embodiment forms the dots in the paper width direction at 360 dpi. Furthermore, the appearances of dot forming will be described later.

The upstream color head group 31*a* has a first color head 311 and a second color head 312. In the embodiment, while the number of heads of the upstream color head 31*a* is two, it may be more than two. Each of the color heads has eight nozzle rows. In short, two nozzle rows are included for 4 colors (CMYK). Furthermore, nozzle arrangement will be described later.

The first color head 311 is positioned lower side in FIG. 2A, and the second color head 312 is positioned upper side in FIG. 2A. In short, the first color head 311 and the second color head 312 form the dots in different areas of the medium. Furthermore, the positions of the paper width direction of the first color head 311 and the second color head 312 partially overlap.

Furthermore, the nozzle arrangement of the first color head 311 and the second color head 312 is described later.

The downstream color head group 31*b* also discharges the color ink for printing the images. The downstream color head group 31*b* of the embodiment forms the dots at 360 dpi in the paper width direction. Furthermore, the downstream color head group 31*b* forms the dots so that they are positioned between the dots in which the upstream color head group 31*a* is formed (between the dots of the paper width direction). Furthermore, the appearance of the dot forming is described later.

The downstream color head group 31*b* is almost the same configuration as the upstream color head group 31*a*, and it has the third color head 313 and the fourth color head 314. In the downstream color head group 31*b*, the third color head 313 is positioned on the lower side in FIG. 2A, and the forth color head 314 is positioned on the upper side in FIG. 2A. However, the downstream color head group 31*b* is deviated with regard to the upstream color head group 31*a* by 1/720 inch in the paper width direction.

The clear ink head group 33 discharges an uncolored and transparent clear ink for the uniformity of the gloss. The clear ink head group 33 of the embodiment forms the dots at 720 dpi in the paper width direction.

The clear ink head group 33 has four heads that consist of a first clear head 331, a second clear head 332, a third clear head 333, and a fourth clear head 334. The first clear head 331 and the third clear head 333 are positioned on the lower side in FIG. 2A, and the second clear head 332 and the fourth clear head 334 are positioned on the upper side in FIG. 2A. For example, the position of the first clear head 331 in the paper width direction is identical to that of the first color head 311, and the position of the second clear head 332 in the paper width direction is identical to that of the second color head 312.

Nozzle Arrangement of Each Head and Dot Formation

Figure 3A:
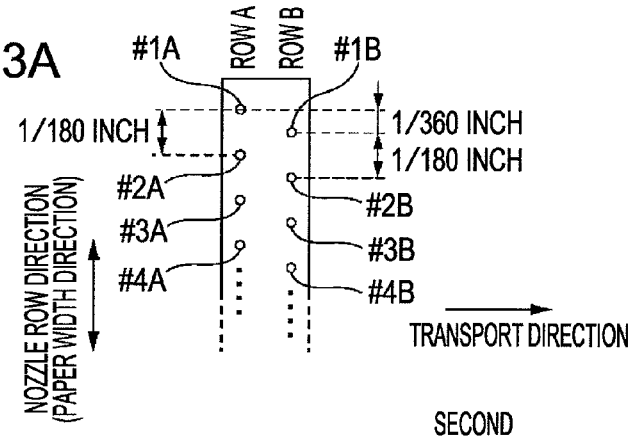
FIGS. 3A to 3C are diagrams for explaining the nozzle arrangement of each head and dot formation.
Figure 3B:
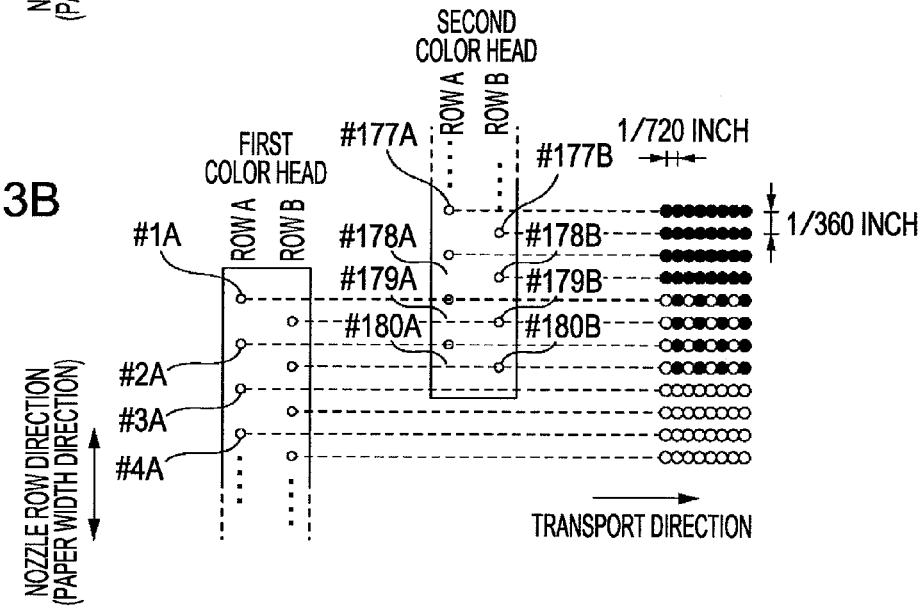
Figure 3C:
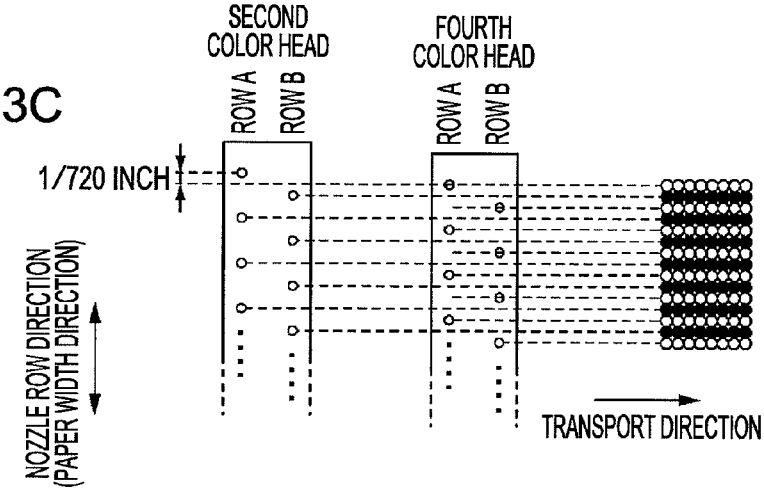

FIGS. 3A to 3C are the drawings for explaining the nozzle arrangement of each head and dot formation.

FIG. 3A is a diagram of the nozzle arrangement of the two black nozzle rows of the first color head 311. Furthermore, while two black nozzle rows of the first color head 311 are described, two black nozzle rows of other color heads are also the same, and they are identical to black of the nozzle arrangement of other colors. Furthermore, the nozzle arrangement of each clear head (the first clear head 331 to the fourth clear head 334) is also identical to that of FIG. 3A.

In each head, the black includes two nozzle rows (Row A and Row B. Each of the nozzle rows has 180 nozzles. Each nozzle is numbered as #1, #2, #3 . . . from the upper side of the drawing. Furthermore, a suffix A is added to each Row A nozzle number, and a suffix B is added to each Row B nozzle number.

The nozzles of each row are arranged at 1/180 inch interval (nozzle pitch) along the direction that intersects to the transport direction (the nozzle row direction). Furthermore, as shown in FIG. 3A, the position of the nozzle row direction of the nozzles of Row A and the position of the nozzle row direction of Row B are deviated by a half nozzle pitch (1/360 inch). For example, with regard to the nozzle row direction (paper width direction), the nozzle of Row B #1 is positioned between the nozzles of Row A #1 and #2. As a result, in each of the color heads, the black nozzles are arranged at the nozzle pitch of 1/360 inch in the nozzle row direction (paper width direction).

Accordingly, it is possible to form the color dot at a resolution of 1/360 inch (360 dpi). Other colors of each head are also identical thereto.

The left side of FIG. 3B indicates the position relationship of the black nozzles of the two color heads of the upstream color head group 31*a* (first color head 311 and second color head 312). Furthermore, while the position relationship of the black nozzles of the upstream color head group 31*a* is described, the black of the two color heads (the third color head 313 and the fourth color head 314) of the downstream color head group 31*b* is also identical thereto. Furthermore, other colors are also identical to black, and the position relationship of the first clear head 331 and the second clear head 332 and the position relationship of the third clear head 333 and the fourth clear head 334 are also identical thereto.

As shown in the drawing, the positions of the nozzle row direction (paper width direction) of the first color head 311 and the second color head 312 partially overlap.

For example, the upper two nozzles (#1A, #2A) in the drawing of Row A of the first color head 311 and the lower two nozzles (#179A, #180A) in the drawing of Row A of the second color head 312 are in the same position (overlap position) with regard to the nozzle row direction (paper width direction). Moreover, the two nozzles (#1B, #2B) of the upper side in the drawing of Row B of the first color head 311 and the two nozzles (#179B, #180B) of the lower side in the drawing of Row B of the second color head 312 are in the same position (overlap position) with regard to the nozzle row direction (paper width direction). In this manner, the nozzles that are in the overlap position with regard to the nozzle direction are referred to as the overlapping nozzles. Moreover, the nozzle other than the overlapping nozzles is referred to as normal nozzle.

The right side of FIG. 3B indicates the black dot formation by the upstream color head group 31*a* (each heads of the left side of FIG. 3B). The white circles in the drawing indicate the dots that are formed by the nozzles of the first color head 311, and the black circles in the drawing indicate the dots that are formed by the nozzles of the second color head 312.

Dot Formation of the Unoverlapped Nozzles

The normal nozzle (the nozzle other than the overlapping nozzles) discharges ink whenever the medium is transported by 1/720 inch. As a result, the dots are formed at 1/720 inch interval in the transport direction. Furthermore, in the part in which the positions of each dots do not overlap, one dot row (the dot row that is arranged in the transport direction) is formed by one nozzle. For example, the uppermost dot row shown in FIG. 3B is formed by the nozzle #177A of the second color head 312, and the lowermost dot row shown in FIG. 3B is formed by the nozzle #4B of the first color head 311. As a result, each of the dot rows is arranged at 1/360 inch interval in the nozzle row direction (paper width direction).

Dot Formation of the Overlapping Nozzles

The overlapping nozzles form a half of the dot as compared with the normal nozzle. For example, as shown in FIG. 3B, the dots are formed by the nozzle #1A of the first color head 311 for each dot (1/360 inch interval) in the transport direction.

Furthermore, the dots are formed by another overlapping nozzle between the dots that are formed by one overlapping nozzle (between the transport direction). For example, the nozzle #179A of the second color head 312 forms the dots between the dots that are formed by the nozzle #1A of the first color head 311 for each dot (1/360 inch interval) in the transport direction. In this manner, one dot row is formed by the two overlapping nozzles. In other words, two overlapping nozzles have the same function as one normal nozzle.

In this manner, the dots are formed by one head group at 1/360 inch interval in the paper width direction.

The left side of FIG. 3C indicates the position relationship of the black nozzles of the upstream color head group 31*a* and the downstream color head group 31*b*. Furthermore, while the position relationship of the black nozzles of the second color head 312 and the fourth color head 314 is described here, the blacks of the first color head 311 and the third color head 313 are also identical thereto. Furthermore, other colors are also identical thereto, and the position relationship of the second clear head 332 and the fourth clear head 334 and the position relationship of the first clear head and the third clear head are also identical thereto.

As shown in the drawing, the position of the nozzle row direction of the black nozzles of the second color head 312 (the upstream color head group 31*a*) and the position of the nozzle row direction of the black nozzles of the fourth color head 314 (the downstream color head group 31*b*) are deviated by 1/4 nozzle pitch (1/720 inch).

The right side of FIG. 3C indicates the black dot formation of the second color head 312 and the fourth color head 314.

The white circles in the drawing indicate the dots that are formed by the black nozzles of the second color head 312. Furthermore, the dot formation of the white circles is identical to the right side of FIG. 3B.

Furthermore, the black circles in the drawing indicate the dots that are formed by the black nozzles of the fourth color head 314. As shown in the drawing, the nozzles of the fourth color head 314 form the dots between the dots that are formed by the nozzles of the second color head 312 at 1/360 inch in the paper width direction. For example, the nozzle #1A of the fourth color head 314 form the dot row between two dot rows that are formed by the nozzle #1A and the nozzle #1B of the second color head 312. As a result, it is possible to form the black dots at a resolution of 1/720 inch (720 dpi).

Preliminary Curing and Main Curing

Figure 4A:
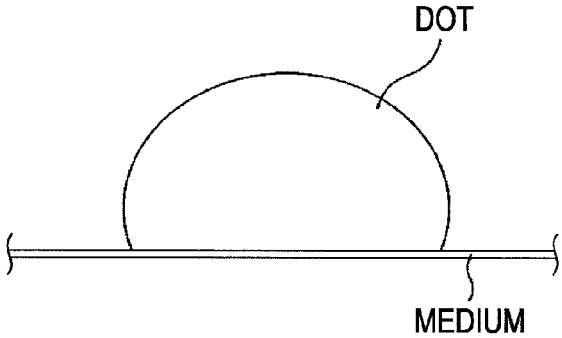
FIGS. 4A to 4C are diagrams of the shapes of UV ink (dots) landed on the medium and the irradiation timing of UV.
Figure 4B:
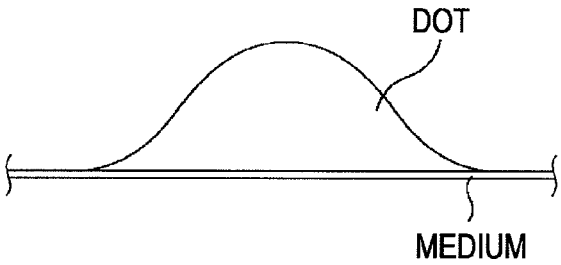
Figure 4C:
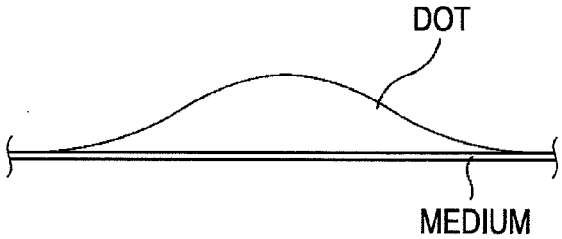

FIGS. 4A to 4C are the diagrams of the shape of UV ink (dots) that is landed on the medium and the UV irradiation timing. Furthermore, the irradiation timing is delayed in order of FIG. 4A, FIG. 4B, and FIG. 4C.

For example, in cases where UV is irradiated so that the spread of the dots is suppressed immediately after the dot formation, it is identical to FIG. 4A. In this case, while it is possible to suppress the spreading, since the size of the unevenness of the medium surface that is constituted by the dots increases, the gloss is deteriorated.

Meanwhile, in cases where UV is initially irradiated by sufficiently spreading the dots, for example, it is identical to FIG. 4C. Specifically, in this case, the gloss is favorable. However, the spread between other inks easily arises.

Next, the curing of the three stages of the first embodiment (a first curing, a second curing, and a main curing) is described.

The first preliminary curing is to prevent spreading among the dots. However, UV irradiation volume in the first embodiment is small, and the dots continue to spread even after the first preliminary curing. In the printer 1 of the embodiment, the dots that are formed by the upstream color head group 31*a* are first preliminarily cured by the first irradiation unit 41*a*. Furthermore, the dots that are formed by the downstream color head group 31*b* are first preliminarily cured by the second irradiation unit 41*b*.

The second preliminary curing is to suppress the spread of the ink (dot). In the printer 1 of the embodiment, the dots (already first preliminarily cured dots) that are formed by the upstream color head group 31*a* and the downstream color head group 31*b* are second preliminarily cured by the second preliminary curing irradiation unit 42. Furthermore, the UV irradiation volume during the second preliminary curing is larger than that during the first preliminary curing. Here, the irradiation volume (mJ/cm$^2$) is a multiplication of an irradiation strength (mW/cm$^2$) by an irradiation time (sec).

Furthermore, in order to increase the irradiation volume, it is possible to strengthen the irradiation strength or lengthen the irradiation time. Furthermore, in order to increase the irradiation time, since the velocity of the medium transport is regular in the embodiment, it is possible to increase the length of the irradiation area of the transport direction of the irradiation units. Furthermore, in order to strengthen the irradiation strength, it is also possible to make the distance between the irradiation units and the medium closer other than strengthening the UV outputs from the irradiation units.

In the embodiment, since the second preliminary curing can be performed after the first preliminary curing at a time interval, an excellent gloss can be obtained, while suppressing spreading between the dots.

Main curing is to solidify the dots completely. The main curing is performed by the main curing irradiation unit 44 which is installed further downstream of the transport direction than the each heads and each irradiation units. Furthermore, UV irradiation volume in the main curing is greater than that in the second preliminary curing. That is to say, the following relationship is established.

Irradiation volume of the first preliminary curing<Irradiation volume of the second preliminary curing<Irradiation volume of the main curing Printing Operation of the First Embodiment FIGS. 5A to 5H show the appearances of the dot formation of the first embodiment.

The medium is transported in the transport direction, thereby passing under the upstream color head group 31*a*. At this time, a controller 60 discharges the ink from the upstream color head group 31*a*. The dots are hereby formed on the medium shown in FIG. 5A at 1/360 inch interval in the paper width direction.

Figure 5A:
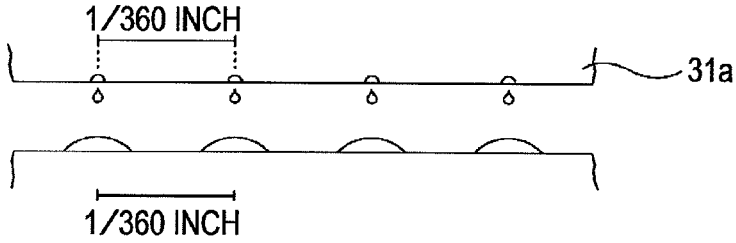
FIGS. 5A to 5H are diagrams of the appearances of the dot formation of a first embodiment.
Figure 5B:
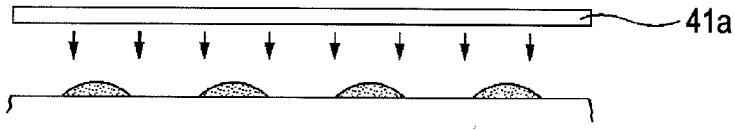

The medium in which the dots are formed by the upstream color head group 31*a* then passes under the first irradiation unit 41*a*. The controller 60 irradiates the UV from the first irradiation unit 41*a* as shown in FIG. 5B to first preliminarily cure the dots formed by the upstream color head group 31*a*. Furthermore, although spreading between the dots is suppressed by the first preliminary curing, the ink continues to spread.

Figure 5C:
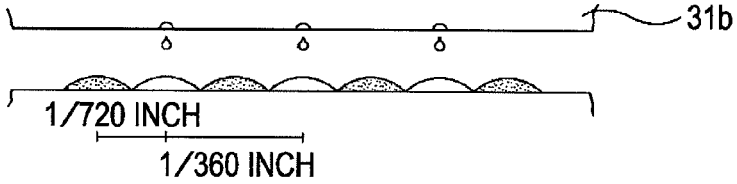

Furthermore, the medium is transported in the transport direction, and it passes under the downstream color head group 31*b*. The controller 60 discharges the ink from each of the nozzles of the downstream head group 31*b*. Furthermore, as shown in FIG. 5C (and FIG. 3C), the downstream color head group 31*b* forms dots (dot rows) between the dots (dot rows) formed in the upstream head group 31*a* at 1/360 inch interval. Therefore, the dots are formed on the medium at 1/720 inch interval in the paper width direction. Furthermore, the dots are formed between already first preliminarily cured dots. Therefore, even though the adjacent dots are contact with each other, spreading does not occur.

Figure 5D:
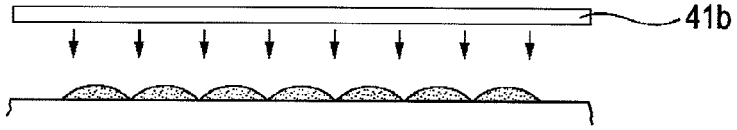

The medium in which the dots are formed by the downstream color head group 31*b* then passes down the second irradiation unit 41*b*. As shown in FIG. 5D, the controller 60 irradiates the UV from the second irradiation unit 41*b* to first preliminarily cure the dots formed by the downstream color head group 31*b*. Furthermore, although the spreading between the dots is suppressed by the first preliminary curing, the ink (dots) continues to spread.

Figure 5E:
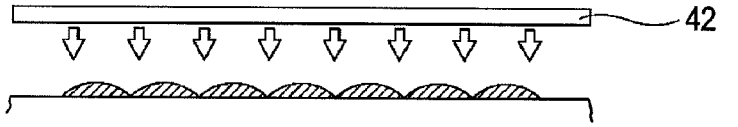

Thereafter, the medium passes under the second preliminary curing irradiation unit 42. The controller 60 irradiates the UV from the second preliminary curing irradiation unit as shown in FIG. 5E to second preliminarily cure the dots on the medium Ink spreading is suppressed by this second preliminary curing.

Figure 5F:
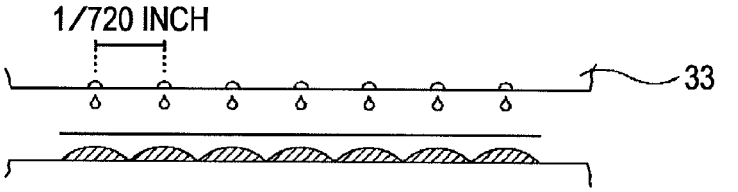

The medium then passes under the clear ink head group 33. The controller 60 discharges the clear ink from four heads (first clear head 331 to fourth clear head 334) of the clear ink head group 33 as shown in FIG. 5F to form the clear dots (apply the clear ink) on the color dots.

Furthermore, since the clear ink is transparent, there is no influence on the image quality even if the clear ink dots spread among themselves. Accordingly, it is possible to form the dots at a resolution of 1/720 inch interval at a time. Furthermore, since clear ink is applied onto already cured (the first and second preliminarily cured) color dots, there is no spreading between the color ink and the clear ink. Furthermore, the cured color ink functions like a wedge, so that the clear inks are not condensed. It is hereby possible to uniformly apply the clear ink. Furthermore, the difference in the elevation of the surfaces is decreased by the application of the clear ink. Therefore, gloss is improved.

Figure 5G:
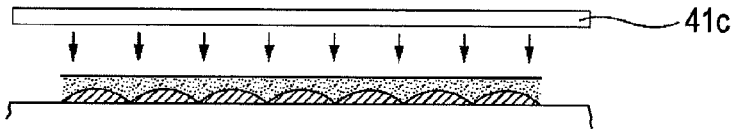
Figure 5H:
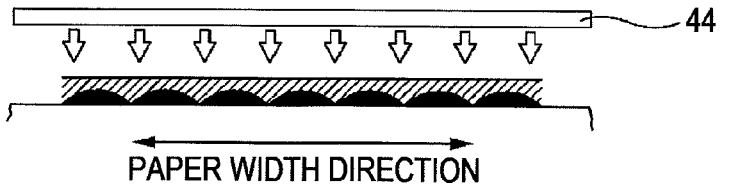

Furthermore, when the applied medium of the clear ink passes under the third irradiation unit 41*c*, the controller 60 irradiates the UV from the third irradiation unit 41*c*, as shown in FIG. 5G. The clear ink applied on the color head hereby is first preliminary cured. Finally, as shown in FIG. 5H, when the medium passes under the main curing irradiation unit 44, the controller 60 irradiates the UV for main curing from the main curing irradiation unit 44. Each of the dots formed on the medium are hereby solidified completely.

Comparative Example

Figure 6:
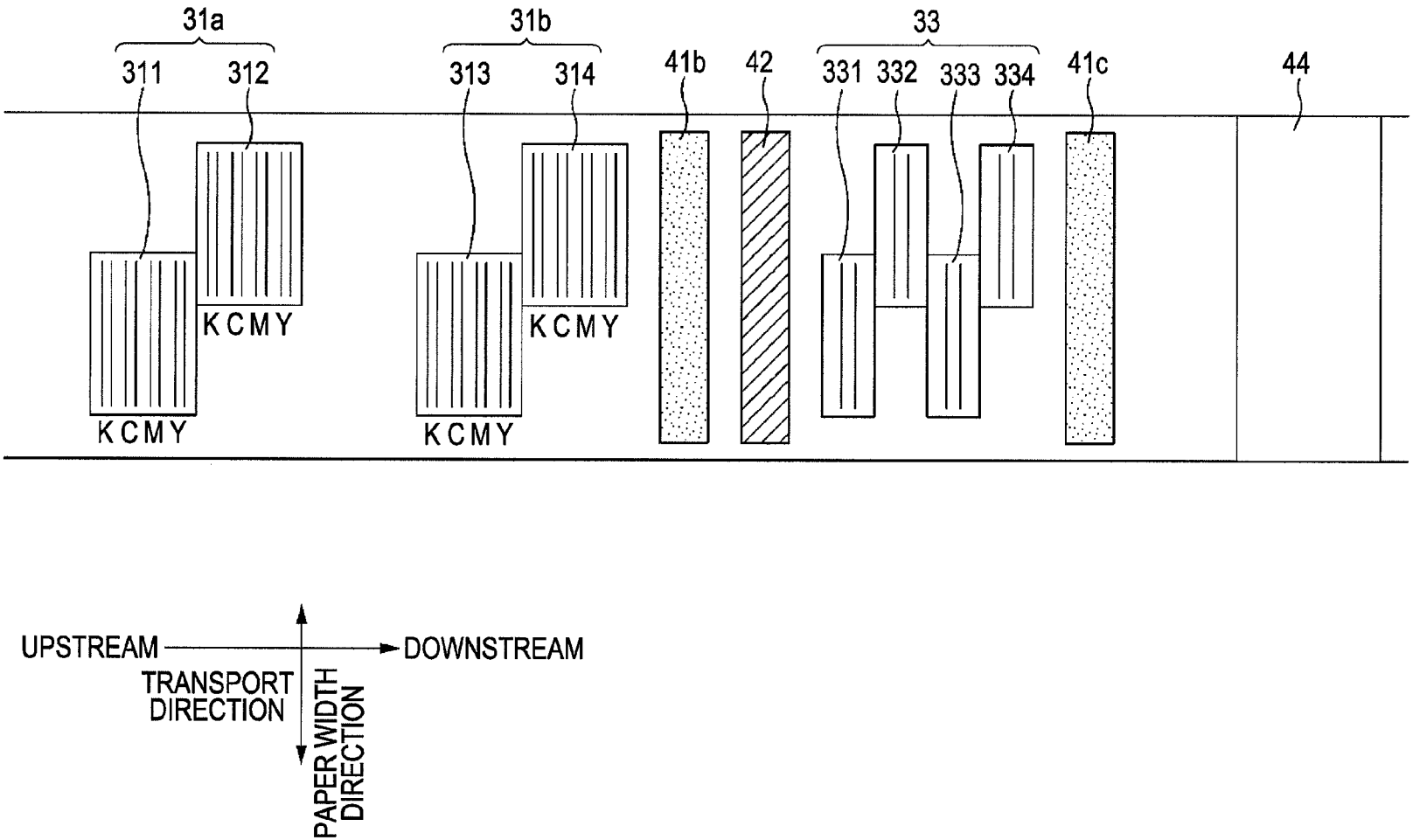
FIG. 6 is a schematic configuration view of the circumference of the printing area of a comparative example.

FIG. 6 is a schematic configuration view of the circumference of the printing area of a comparative example. The first irradiation unit 41*a* is not installed as compared with the embodiment (FIG. 2B). Furthermore, FIGS. 7A to 7C are diagrams of the features of the dot formation of the comparative example.

Figure 7A:
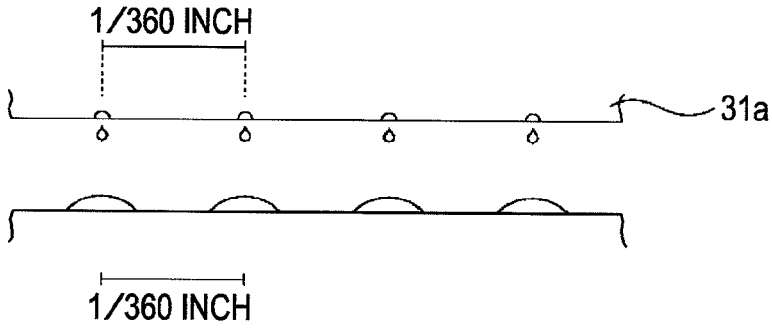
FIGS. 7A to 7C are illustration diagrams of the appearances of the dot formation of the comparative example.

In FIG. 7A, the dots are formed at 1/360 inch interval in the paper width direction by the upstream color head group 31*a* in the same manner as the first embodiment (FIG. 5).

Figure 7B:
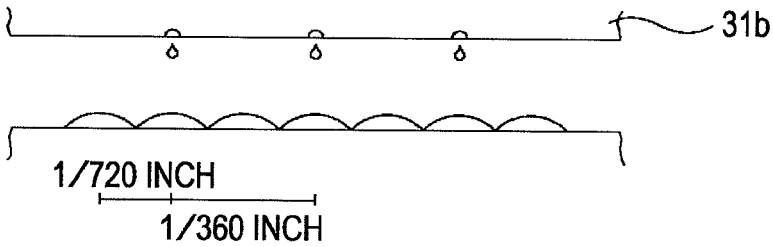

Furthermore, in the comparative example, before the dots of FIG. 7A (the dots that are formed by the upstream color head group 31*a*) are preliminarily cured, dots are formed between the dots by the downstream color head group 31*b* as shown in FIG. 7B. This causes the spread of the inks (The inks spread between the adjacent inks in the left and right direction in the drawing).

Figure 7C:
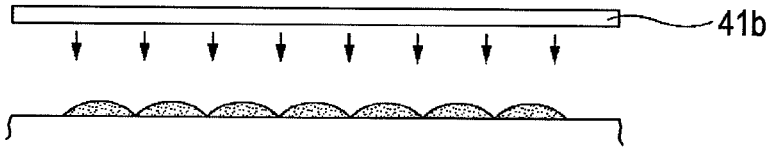

Thereafter, the dots formed on the medium are preliminarily cured (the first preliminarily cured) by the second irradiation unit 41*b*, as shown in FIG. 7C. However, since the inks are already spreading, the image quality is not improved as compared with the main embodiment. Since the description after the first preliminary curing is identical to that of the first embodiment, the description thereof is omitted.

First Modified Example of the First Embodiment

The diameters of the dots enlarge, as the time from the dot forming to the preliminary curing is lengthened. For example, in the configuration of FIG. 2A, the dots formed by the first color head 311 are larger than the dots formed by the second color head 312. Furthermore, the dots formed by the third color head 313 are larger than the dots formed by the fourth color head 314. As a result, in FIG. 2A, the dots formed under the medium are larger than the dots formed over the medium. This causes the difference of the image quality between the upper and lower sides of the medium.

Figure 8:
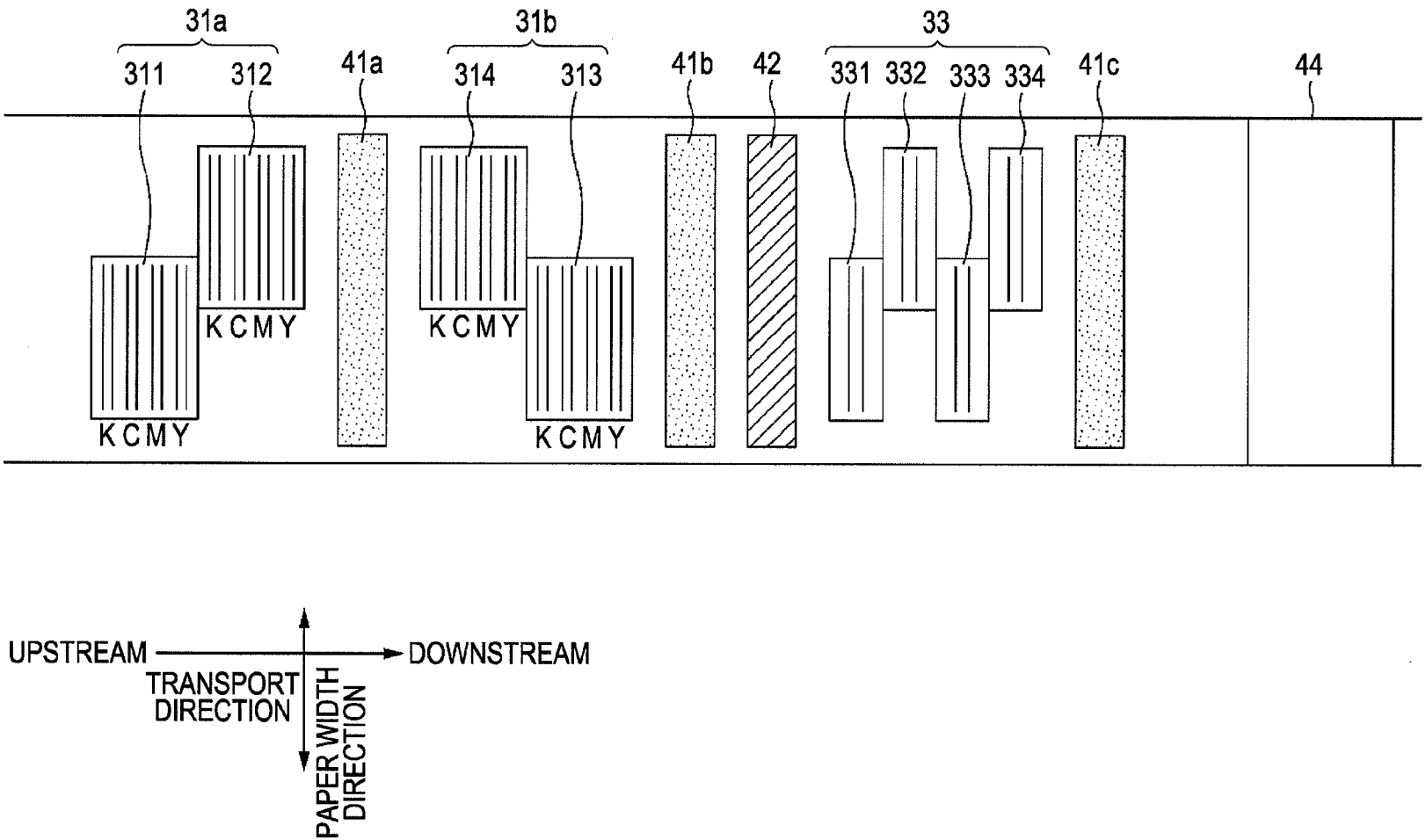
FIG. 8 is a schematic configuration view of the circumference of the printing area of a first modified example of the first embodiment.

FIG. 8 is a schematic configuration view of the circumference of the printing area of the first modified example of the first embodiment. The position relationship of the upstream and the downstream of the transport direction of the third color head 313 and the fourth color head 314 differs as compared with FIG. 2A.

In the configuration of FIG. 8, the dots formed by the first color head 311 are larger than the dots formed by the second color head 312. However, the dots formed by the third color head 313 are smaller than the dots formed by the fourth color head 314. This makes the image qualities in the upper and lower sides of the medium uniform.

Second Modified Example of the First Embodiment

In FIGS. 3B and 3C, the dots are formed at 1/720 inch in the transport direction. Therefore, although it is possible to suppress the spreading of the ink among the dots which are adjacent in the paper width direction, it is impossible to suppress the spreading of the ink among the dots which are adjacent in the transport direction.

In the second modified embodiment, the arrangement of the dots is changed, without change of the configuration or the arrangement of the nozzles.

Figure 9:
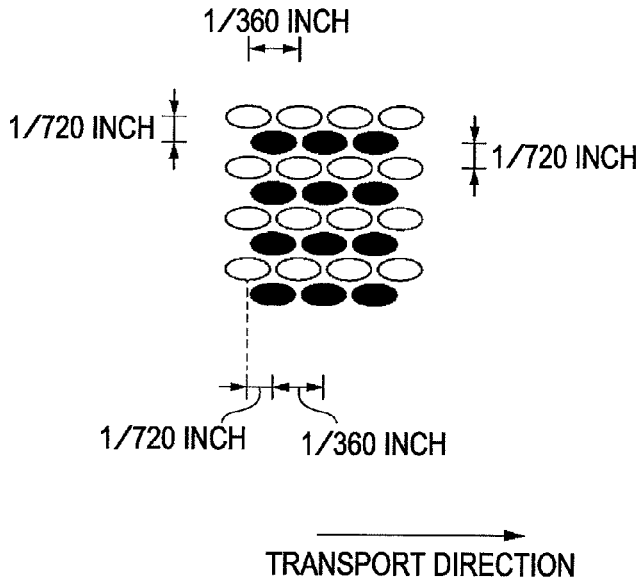
FIG. 9 is a diagram that illustrates the dot arrangement of a second modified example of the first embodiment.

FIG. 9 shows the dot arrangement of second modified example of the first embodiment. The white circles in the drawing indicate the dots which are formed by the nozzles of the upstream color head group 31*a*, and the black circles indicate the dots which are formed by the nozzles of the downstream color head group 31*b*. In the second modified example, the dot interval in the transport direction is 1/360. In this manner, it is possible to suppress the spreading of the ink among the dots which are adjacent in the transport direction.

Furthermore, in the second modified embodiment, as shown in FIG. 9, the position in the transport direction of the dots (black circles) which are formed by the nozzles of the downstream color head group 31*b* is deviated by 1/720 inch with regard to the dots (white circles) which are formed by the nozzles of the upstream color head group 31*a*. Accordingly, the gaps by the spreading of the dot interval in the transport direction can be made invisible.

Furthermore, in the second embodiment, if the transport velocity in printing is high, each of the dots lengthen in the transport direction, thereby making the gaps by the spreading of the dot interval in the transport direction invisible.

Second Embodiment

In the first embodiment, each of the color heads is equipped with the nozzle rows of CMYK 4 color. For this reason, in the configuration of the dot formation by the upstream color head group 31*a*, first of all, after 360 dpi images of each colors of CMYK are formed on the lower side (lower side in FIG. 2A) of the medium by the first color heads 311, 360 dpi images of each colors of CMYK are formed on the upper side of the medium by the second color heads 312. For example, taking notice of black, there is a time difference from the time when the dots are formed under the medium by the first color head 311 to the time when the dots are formed over the medium by the second color head 312. The reason is that the dots of other colors are formed between the time when the dots are formed under the medium by the first color head 311 and the time when the dots are formed over the medium by the second color head 312. There is a difference in the size of the dots between the upper and lower sides of the medium due to an influence of the time difference, and for this reason, the image qualities differ between the lower and upper sides of the medium. Furthermore, this is a particular problem with the UV in which the dots continue to spread even after dot formation.

Accordingly, in the second embodiment, when the dots are formed by the upstream head group, after the first head of black forms the dots on the lower side of the medium, the second head of black forms dots on the upper side of the medium, before forming the dots of other colors.

Figure 10:
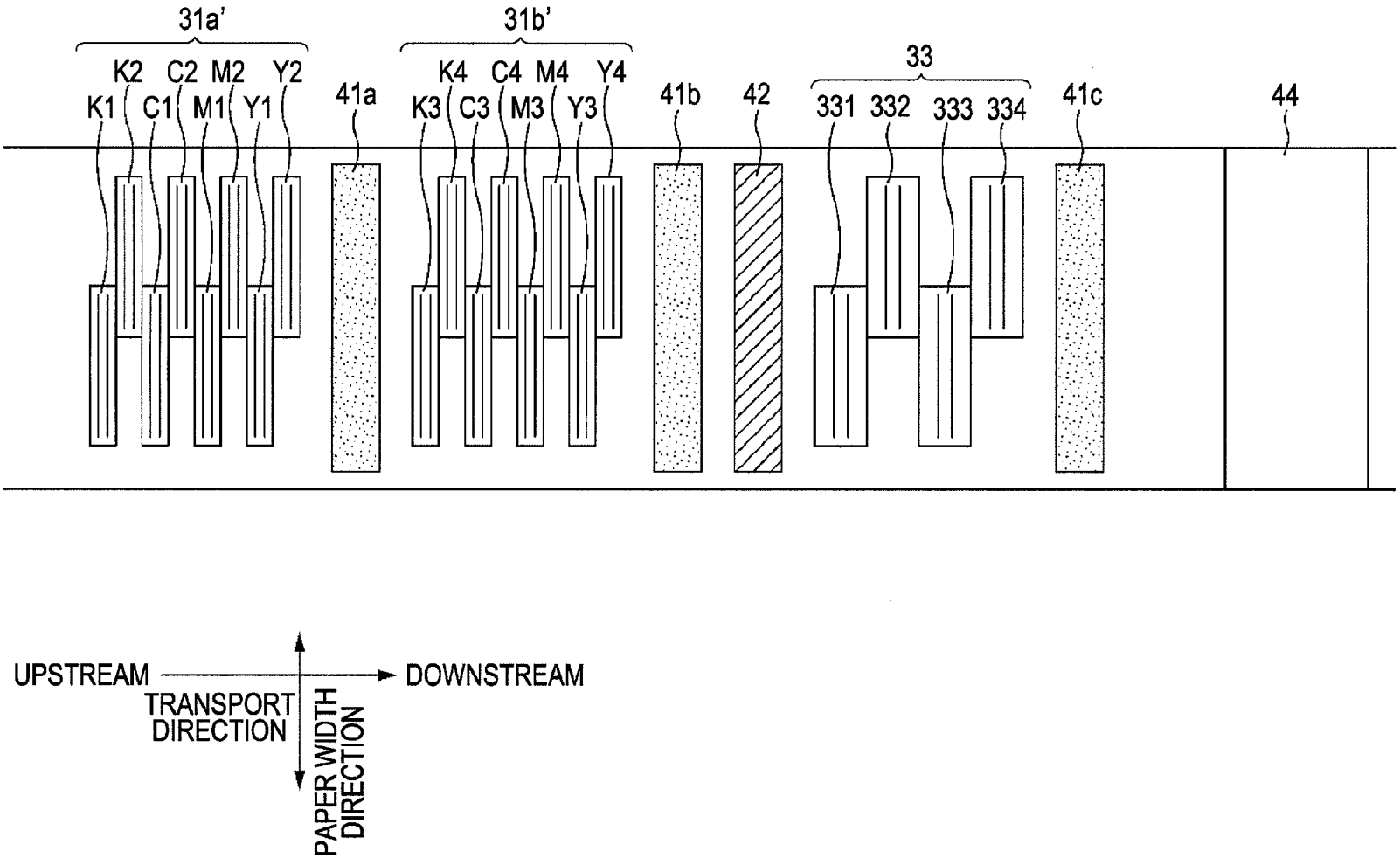
FIG. 10 is a schematic configuration view of the circumference of the printing area of a second embodiment.

FIG. 10 is a schematic configuration view of the circumference of the printing area of a second embodiment. Furthermore, in FIG. 10, the parts which are identical to those of FIG. 2A are indicated by same reference numerals and the description thereof is omitted. The head unit 30 of the second embodiment has an upstream color head group 31*a*' and a downstream color head group 31*b*'.

The upstream color head group 31*a*' discharges the color ink for image printing. Furthermore, the upstream color head group 31*a*' forms the dots at 360 dpi in the paper width direction.

A head group of each color ink of four colors (CMYK) is installed in the upstream color head group 31*a*'.

For example, two heads of a first head K1 and a second head K2 are provided as black head group which is head group of black. The position relationship of the first head K1 and the second head K2 is the same as that of FIG. 3B. The configuration of the head group of other color is also identical.

Furthermore, each head group of C, M, Y is arranged downstream of the transport direction of the head group of black (K) in order.

The configuration of the downstream color head group 31*b*' is also almost identical to that of the upstream color head group 31*a*'. However, the downstream color head group 31*b*' is deviated by 1/720 inch with regard to the upstream color head group (which is the same relationship as FIG. 3C).

In the second embodiment, the downstream color head group 31*b*' forms the dots between already previously cured dots (the dots that are formed by the upstream color head group 31*a*'), in the same manner as the first embodiment. Accordingly, the ink does not spread among the dots which are adjacent in the paper width direction.

Furthermore, in the second embodiment, as compared with the first embodiment, it is possible to reduce the time difference from the time when the dots are formed under the medium by the first color head 311 to the time when the dots are formed over the medium by the second color head 312. As a result, the size of the dots of each color in the upper and lower sides of the medium can be made uniform and the image quality can be improved.

Third Embodiment

While the line printer is used as the liquid discharging device in the above-mentioned embodiments, in the third embodiment, a printer (so-called serial printer) is used which prints the images on the medium by repeatedly performing a transport operation for transporting the medium in the transport direction and performing a dot forming operation that discharges the ink while moving the head in a direction which intersects the transport direction to form the dots.

Figure 11:
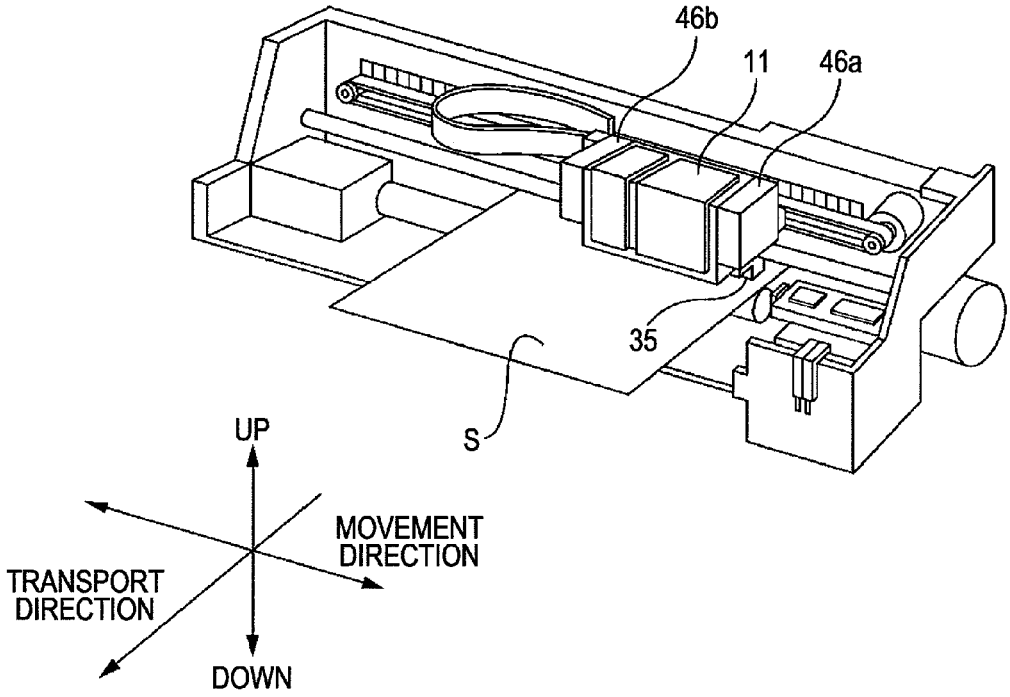
FIG. 11 is a perspective view of the printer of a third embodiment.

FIG. 11 is a perspective view of the printer (serial printer) of the third embodiment.

A carriage 11 is able to reciprocate in the movement direction and is driven by a carriage motor (not shown). Furthermore, the carriage 11 detachably supports an ink cartridge which houses the ink.

A head 35 has a plurality of nozzles for discharging the UV ink and is installed in the carriage 11. For this reason, when the carriage 11 moves in the movement direction, a head 35 also moves in the movement direction. The head 35 intermittently discharges the ink during the movement in the movement direction, so that the dot lines (raster lines) according to movement direction are formed on the medium.

Irradiation units for preliminary curing 46*a*, 46*b* are to cure the dots which are formed on the medium, and they are installed in the both ends of the movement direction of the carriage 11 in a manner that pinch the head 35 therebetween, respectively. Accordingly, when the carriage 11 moves in the movement direction, the irradiation units for preliminary curing 46*a*, 46*b* also move in the movement direction and irradiate the UV toward the medium.

Figure 12:
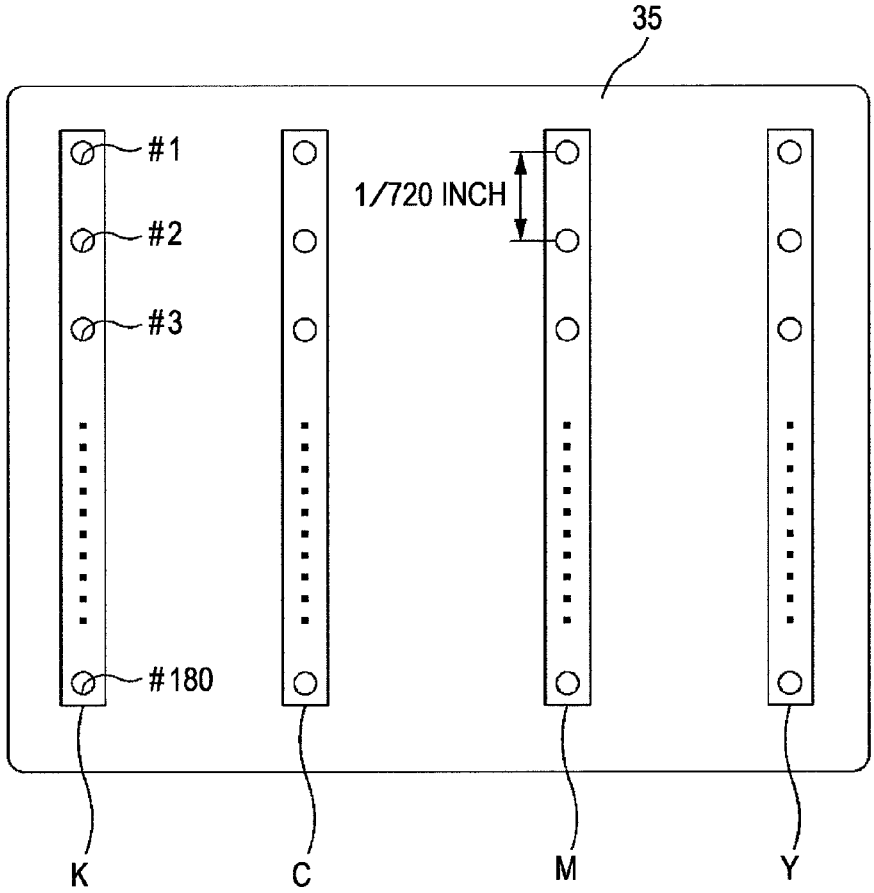
FIG. 12 is a diagram of the configuration of the head of the third embodiment.
Figure 12:
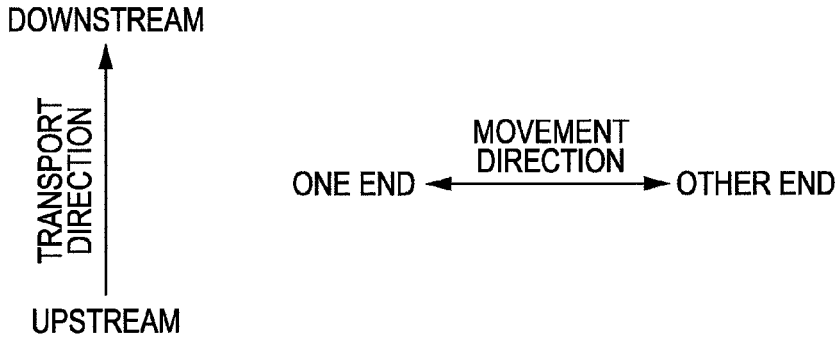

FIG. 12 is a diagram of one example of the configuration of the head 35 of the third embodiment. On the lower surface of the head 35, as shown in FIG. 12, the nozzle rows for the color ink (black ink nozzle group K, cyan ink nozzle row C, magenta ink nozzle row M, and yellow ink nozzle row Y) are formed. Each of the nozzle rows includes a plurality of the nozzles (180 nozzles in FIG. 12) which are the discharging openings for discharging the UV inks of each color. The nozzles of each nozzle rows are arranged at 1/720 inch interval in the transport direction.

In the nozzles of each nozzle rows, small numbers are indicated near the nozzles of the downstream of the transport direction. A piezo element (not shown) as the driving element for discharging UV inks from each nozzles is installed in each of the nozzles. This piezo element is driven by the driving signals, so that droplet-shaped UV inks are discharged from each nozzle. Discharged UV inks impact on the medium to form the dots.

Printing Operation of the Third Embodiment

In the printer of the third embodiment, the dot forming operation that discharges UV inks from the nozzles of the head 35 during the movement in the movement direction to form the dots and the transport operation that transports the medium in the transporting direction are performed repeatedly and alternately, thereby printing the images composed of the plurality of the dots on the paper. Furthermore, the dot forming operation is hereinafter called as a pass. Furthermore, the nth pass is called as pass n.

Figure 13A:
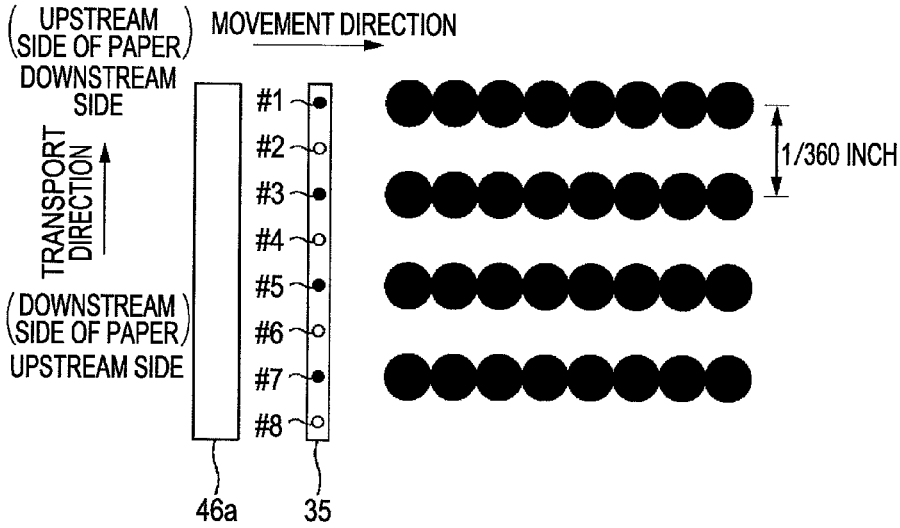
FIGS. 13A and 13B are diagrams of the dot forming operation in the third embodiment.
Figure 13B:
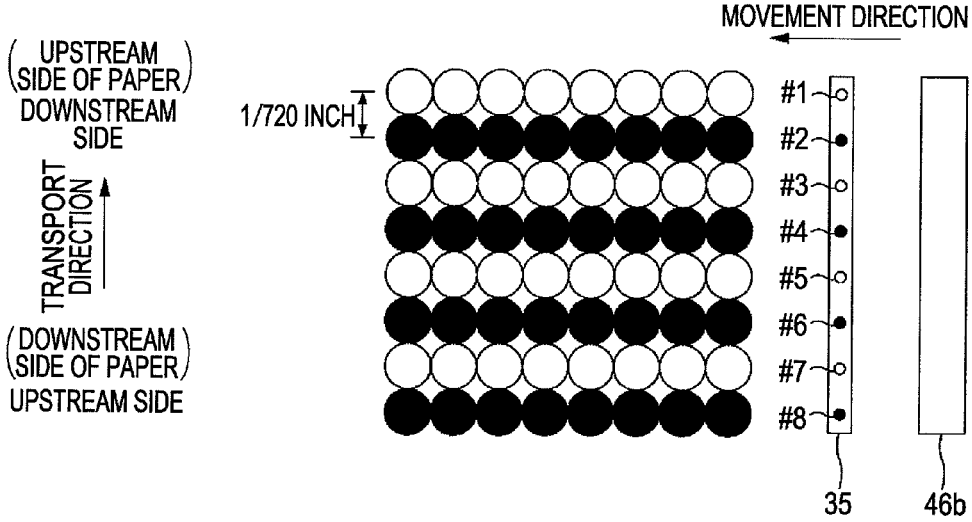

FIGS. 13A and 13B are diagrams of the dot forming operation in the third embodiment.

FIG. 13A is a diagram of the initial dot forming operation (pass 1). That is to say, it indicates an outward pass. Furthermore, in this drawing, one (for example, black ink nozzle group K) of the four nozzle rows of the head 35 is indicated for simplifying the description. Furthermore, the number of the nozzles is eight for simplifying the description.

The nozzles indicated by the white circles in the drawing are the nozzles which are unable to discharge the ink, and the nozzles indicated by the black circles in the drawing are the nozzles which are able to discharge the ink.

In pass 1, as shown in FIG. 13A, by using only an odd number of the nozzles of 1/720 inch interval nozzles (using at one interval), the dot rows are formed at 1/360 inch interval. Furthermore, in the dot forming operation, the preliminary curing is performed by the curing unit for preliminary curing 46*a* that is attached aside the carriage 11.

Furthermore, FIG. 13B is a diagram of the next dot forming operation (pass 2). That is to say, it indicates a return dot forming operation. In the embodiment, the next (return) dot forming operation is performed without the transport of the medium.

In pass 2, by using only an even number of the nozzles, the dot row is formed at intervals of 1/360 inch. In this manner, the nozzles to be used are changed for the outward and return movements. As a result, the dot rows are formed between the 1/360 inch interval dot rows that are formed by pass 1. In the third embodiment, the dots are also formed between already cured dots. As a result, the inks do not spread among the adjacent dots in the transport direction. Furthermore, the movement direction of pass 2 is opposite to that of pass 1, so that the preliminary curing is performed by the preliminary curing irradiation unit 46*b* that is different from pass 1.

Thereafter, the medium is transported in the transport direction.

Hereinafter, the transport of the medium and the dot forming operation of FIGS. 13A (the outward) and 13B (the return) are repeated.

In this manner, in the third embodiment, the dots are formed by the return pass between the dots that are formed by the outward pass and preliminarily cured. Accordingly, the ink spreading among the dots can be suppressed.

Other Embodiments

Although as one embodiment, the printers, etc. are described, the above embodiment is intended to facilitate understanding of the invention, and it is not intended to analyze the invention in a limited manner. The invention can be modified and improved without departing from its intent, and at the same time, it is needless to say that the equivalent is included in the invention. Particularly, the embodiments described hereinafter are also included in the invention.

Printer

While the printer is described as one example of the embodiment in the above-mentioned embodiments, the invention is not limited thereto. For example, it is preferable that the same technique as the embodiment be applied to various liquid discharging devices that apply the ink jet technique such as a color filter manufacturing device, a dyeing device, a micro processing device, a semiconductor manufacturing device, a surface processing device, a three-dimensional prototyping device, a liquid vaporizer, an organic EL manufacturing device (in particular, a polymer EL manufacturing device), a display manufacturing device, a film forming device, and a DNA chip manufacturing device.

UV Ink

In the above-mentioned embodiments, the ink (UV ink) to be cured by being irradiated with ultraviolet (UV) was discharged from the nozzles. However, the discharged liquid from the nozzles is not limited to the ink that is cured by UV light, it is also possible to use ink that is cured by a visible ray. In this case, each of the irradiation units irradiates the visible ray (electromagnetic wave) of a wavelength in which the ink is cured.

Clear Ink 1

In the above-mentioned embodiments, while the uncolored and transparent clear ink was used in forming the dots other than the images, it is not limited to the clear ink. For example, it is possible to use a translucent processing liquid that gives the surface of a medium gloss. Furthermore, the process may not be the gloss. A processing liquid that regulates the texture of the surface of the medium can be also used.

Clear Ink 2

While a clear ink was applied after the color dot formation in the above-mentioned embodiments, a clear ink may not be applied. In this case, irradiation by the third irradiation unit 41C does not have to be performed.

Clear Ink 3

Instead of a clear ink, a background ink, like a white ink, for forming the background of images is also possible to be discharged. In this case, the dots are formed by the white color outside the area in which the images are formed by the color ink.

Like the clear ink, even though the white ink dots spread among themselves, image quality is also not influenced. In cases where white ink is used, it is possible that the arrangement of the nozzles of the white ink is the same as that of the above-mentioned clear ink.

Furthermore, the background ink is not limited to the white ink. For example, if the medium is a cream color, a cream color ink that is identical to the medium may be used for the background.

Nozzle

In the above-mentioned embodiments, two nozzle rows (Row A Row B) are installed for each color of each head, the nozzle rows are constructed in which a plurality of the nozzles are arranged by the two nozzle rows at 1/360 inch intervals in the paper width direction. In other words, the nozzles are placed in the shape of a zigzag, so that the nozzle row in constructed in which a plurality of the nozzles are arranged by the two nozzle rows at 1/360 inch interval in the paper width direction. However, the configuration of the nozzles is not limited thereto.

For example, it is also possible to construct the nozzles by placing the nozzles on a straight line.

Second Preliminary Curing

While the second preliminary curing was performed by the second preliminary curing irradiation unit 42 in the above-mentioned embodiments, the second preliminary curing by the second preliminary curing irradiation unit 42 may not be performed.

Furthermore, in that case, it is also possible that the irradiation volume of the second irradiation unit 41*b* of the first preliminary curing irradiation unit 41 be made greater than that of the first irradiation unit 41*a* to cure until the curing of the same level as the second preliminary curing (preventing ink spreading, and suppressing dot spreading) by the second irradiation unit 41*b* of the first preliminary curing irradiation unit 41. In that case, the dots formed by the upstream color head group 31*a* are second preliminarily cured by the second irradiation unit 41*b* of the first preliminary curing irradiation unit 41, so that they are cured until the curing of the same level as the second preliminary curing, meanwhile the dots formed by the downstream color head group 31*b* are second preliminarily cured by one time irradiation of the second irradiation unit 41*b* of the first preliminary curing irradiation unit 41, so that they are cured till the curing of the same level as the second preliminary curing. In this case, the dots that are formed by the upstream color head group 31*a* and the dots that are formed by the downstream color head group 31*b* have different sizes of dot area on the medium, because there is a difference from the time when the dots are formed to the time when they are cured until the curing of the same level as the second preliminary curing.

In other words, the dots that are smaller than the area of the dots formed by the downstream color head group 31*b* are buried between the dots that are greater than the area of the dots formed by the upstream color head group 31*a*. However, since the size of an actual dot is very small, when seen as an image on the medium, the size difference between the dots that are formed by the upstream color head group 31*a* and the dots that are formed by the downstream color head group 31*b* is not noticeable, and it is possible to cover over the medium so as the dots do not to contact each other.

Furthermore, in cases where the irradiation volume of the second irradiation unit 41*b* of the first preliminary curing irradiation unit 41 is made greater than that of the first irradiation unit 41*a*, the irradiation by the second preliminary curing irradiation unit 42 is also performed, and it is also possible to cure until the same level as the second preliminary curing by the irradiation by the second preliminary curing irradiation unit 42.

The entire disclosure of Japanese Patent Application No. 2009-030320, filed Feb. 12, 2009 is expressly incorporated by reference herein.

What is claimed is:

1. A liquid discharging apparatus comprising:

a first discharging unit that discharges first droplets of a liquid onto a medium, wherein the liquid is cured by irradiation of electromagnetic waves onto the liquid;

a second discharging unit that discharges second droplets of the liquid onto the medium, wherein the second discharging unit is located downstream of the first discharging unit in a medium transport direction;

a first irradiation unit that irradiates the at least one of the first and the second droplets with electromagnetic waves, wherein the first irradiation unit is located downstream of the first and second discharging units in the medium transport direction;

a third discharging unit that discharges third droplets of the liquid onto the medium, wherein the third discharging unit is located downstream of the first irradiation unit in the medium transport direction;

a fourth discharging unit that discharges fourth droplets of the liquid, wherein the fourth discharging unit is located downstream of the first irradiation unit and upstream of the third discharging unit in the medium transport direction;

a second irradiation unit that irradiates at least one of the first, second, third, and fourth droplets with electromagnetic waves, wherein the second irradiation unit is located downstream of the third and fourth discharging units in the medium transport direction;

wherein a first distance between the first discharging unit and the first irradiation unit is longer than a second distance between the second discharging unit and the first irradiation unit, and a third distance between the third discharging unit and the second irradiation unit is shorter than a fourth distance between the fourth discharging unit and the second irradiation unit, wherein the first discharging unit is located to one side of the second discharging unit in a transverse direction that is generally transverse to the medium transport direction, and the third discharging unit is located to the one side of the fourth discharging unit in the transverse direction.

2. The liquid discharging apparatus according to claim 1, wherein a part of the first discharging unit overlaps with a part of the second discharging unit in the medium transport direction.

3. The liquid discharging apparatus according to claim 2, wherein the part of the first discharging unit comprises an edge portion of the first discharging unit in a side other than the one side in the transverse direction, and the part of the second discharging unit comprises an edge portion of the second discharging unit in the one side in the transverse direction.

4. The liquid discharging apparatus according to claim 2, wherein a part of the third discharging unit overlaps with a part of the fourth discharging unit in the medium transport direction.

5. The liquid discharging apparatus according to claim 4, wherein:

the part of the first discharging unit comprises an edge portion of the first discharging unit in a side other than the one side in the transverse direction;

the part of the second discharging unit comprises an edge portion of the second discharging unit in the one side in the transverse direction;

the part of the third discharging unit comprises an edge portion of the third discharging unit in the side other than the one side in the transverse direction; and the part of the fourth discharging unit comprises an edge portion of the fourth discharging unit in the one side in the transverse direction.

6. The liquid discharging apparatus according to claim 1, wherein a part of the third discharging unit overlaps with a part of the fourth discharging unit in the medium transport direction.

7. The liquid discharging apparatus according to claim 6, wherein the part of the third discharging unit comprises an edge portion of the third discharging unit in a side other than the one side in the transverse direction, and the part of the fourth discharging unit comprises an edge portion of the fourth discharging unit in the one side in the transverse direction.

* * * * *